US006715236B2

(12) United States Patent
Mullet

(10) Patent No.: US 6,715,236 B2
(45) Date of Patent: Apr. 6, 2004

(54) ANTI-DROP DEVICE FOR VERTICALLY MOVING DOOR

(75) Inventor: Willis J. Mullet, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/948,086

(22) Filed: Sep. 6, 2001

(65) Prior Publication Data

US 2003/0051408 A1 Mar. 20, 2003

(51) Int. Cl.[7] ..... E05D 13/00; E05D 15/38

(52) U.S. Cl. ..... 49/322; 49/197; 160/201

(58) Field of Search ..... 49/199, 197, 200, 49/322, 449; 187/343, 345; 160/201, 191, 188, 192, 189, 190, 291, 296, 298; 16/DIG. 1, 198; 292/92, 93, 94, 235, DIG. 65, 36

(56) References Cited

U.S. PATENT DOCUMENTS

| | | | | | |
|---|---|---|---|---|---|
| 1,936,269 | A | | 11/1933 | Schaffert et al. | 268/59 |
| 2,012,336 | A | | 8/1935 | Blodgett | 20/20 |
| 2,064,470 | A | | 12/1936 | Heckman | 20/20 |
| 2,099,191 | A | | 11/1937 | Blodgett | 20/20 |
| 2,185,828 | A | * | 1/1940 | Blodgett | 49/322 |
| 2,294,360 | A | | 9/1942 | Blodgett | 20/20 |
| 3,412,780 | A | * | 11/1968 | Moler | 160/191 |
| 4,385,471 | A | * | 5/1983 | Gabry et al. | 49/322 |
| 4,520,591 | A | * | 6/1985 | Calvagno | 49/322 |
| 4,604,828 | A | * | 8/1986 | Baarse | 49/322 |
| 4,914,862 | A | | 4/1990 | Gregory | 49/322 |
| 4,956,938 | A | * | 9/1990 | DeMent | 49/322 X |
| 5,046,544 | A | * | 9/1991 | Coluccio | 160/201 |
| 5,291,686 | A | * | 3/1994 | Sears et al. | 49/322 |
| 5,698,073 | A | * | 12/1997 | Vincenzi | 160/188 |
| 5,743,046 | A | | 4/1998 | Siegler et al. | 49/199 |
| 6,024,155 | A | | 2/2000 | Sharp | 160/201 |
| 6,042,158 | A | * | 3/2000 | Horn | 49/322 X |
| 6,189,266 | B1 | * | 2/2001 | Mihalcheon | 49/322 |
| 6,253,824 | B1 | * | 7/2001 | Mullet et al. | 160/188 |
| 6,279,268 | B1 | * | 8/2001 | Beaudoin et al. | 49/322 |

FOREIGN PATENT DOCUMENTS

| | | | | |
|---|---|---|---|---|
| CH | 340 337 | | 8/1959 | |
| DE | 3413236 | | 10/1985 | E05D/13/00 |
| DE | 37 10237 | A1 | 6/1988 | E05D/13/00 |
| DE | 0172351 | | 10/1988 | |
| DE | 0678641 | | 8/1999 | |
| FR | 71.04356 | | 9/1972 | |
| FR | 2697570 | * | 5/1994 | 49/322 |
| FR | 2715965 | | 8/1995 | E05D/15/38 |

* cited by examiner

*Primary Examiner*—Hugh B. Thompson, II
(74) *Attorney, Agent, or Firm*—Renner, Kenner, Greive, Bobak, Taylor & Weber

(57) ABSTRACT

A door system including a door movable between a closed vertical position and an open horizontal position, a cable interconnected to said door near the bottom thereof, the cable extending along a vertical line adjacent the door and being normally, substantially taut, and an anti-drop assembly having a pawl pivotally supported on the door, a stop surface formed adjacent the door and a spring operable to urge the pawl toward engagement with the stop surface, wherein the pawl is oriented such that it rotates in a plane passing through the cable and placed in contact therewith such that the taut cable opposes the biasing force of the spring, whereby upon the cable going slack, the spring biases the pawl into engagement with the stop surface to decelerate the door.

22 Claims, 6 Drawing Sheets

ANTI-DROP DEVICE FOR VERTICALLY MOVING DOOR

TECHNICAL FIELD

The present invention relates generally to anti-drop systems used to prevent free fall of vertically moving doors, such as garage doors or the like. More particularly, the present invention relates to such an anti-drop system having a pawl assembly that, in response to a loss of tension in the counterbalance cable, engages a stop surface adjacent to the door to impede its fall. More specifically, the present invention relates to a pawl assembly biased toward engagement with the stop surface but checked by the force of a taut counterbalance cable attached to the door and lying within the pawl's rotational plane, whereby release of the tension within the cable, causing the cable to go slack, allows the pawl to swing into engagement with the stop surface and impede the fall of the door.

BACKGROUND ART

Devices which prevent the inadvertent free-fall of a vertically movable door, such as a garage door, are known in the art. One type of anti-drop system which has been used in the industry employs a spring-loaded bar that is driven outwardly such that it enters a slot on a rail held adjacent to the door to stop the door from falling. In this system, two horizontally oriented bars housed at the very bottom of the door are mounted side by side. The first bar is rotatable about its own axis and is attached to the lift cable of the counterbalance system of the door by means of a shift pin supported on the first bar. The pin has an oblique slope and is oriented such that when the cable is taut, the pin blocks the axial path of the spring-loaded second rod. When tension is released, however, the pin, due to its oblique slope, shifts to a position that clears the second bar allowing the second bar to move into engagement with the slots formed in the rail supported adjacent to the edge of the door. Since the shift pin is located externally of the edge of the door, clearance must be provided for the shift pin between the door edge and the rail, such that the shift pin is free to clear the second bar. This spacing may allow fluid or debris to gather in the area between the rail and the door. This debris and fluid may gather around the anti-drop mechanism and deleteriously affect its performance by interfering with proper operation of the system or corroding its components.

When operating to stop the door, the spring-loaded bar is driven axially outwardly to project through the slots formed in the rail. In this device, the bar must extend through the slot to effectively stop the door. Partial contact with the slot could cause the bar to deflect from the rail or be deformed such that the bar will not hold the door's weight. In this device, the end of the second bar is flat lying in a plane parallel to the rail, thereby offering little or no resistance to slow the downward movement of the door. Due to the uninhibited fall of the door prior to stopping, the spring-loaded bar is subjected to a large shock load when it catches the fall of the door. It is believed that this shock load could be sufficient to bend or otherwise distort the bar requiring replacement or repair before the anti-drop mechanism could be reused. In any event, assuming the spring-loaded bar is still functional after stopping the door, the bar must be manually reset and held until tension within the cable is restored sufficiently to retain the bar. Although it has been proposed to incorporate a stop flange in place of the slots formed within a rail, it will be appreciated that, despite this modification, this system has the same disadvantages. In addition, the flange in this system may bend or fail under the shock load created when stopping the door.

As a further disadvantage, when used with spring-type counterbalance systems, the tension on the cable varies dependent on the position of the door. Typically, the greatest spring force and, thus, the greatest tension in the cable, is at the closed position. As the door approaches the open position, the spring tension in the cable is reduced and potentially could be reduced to an extent that the spring force driving the bar is not balanced resulting in inadvertent engagement of the stop mechanism. Moreover, the location of the bar mechanism at the very bottom of the door exposes it to dirt, debris and water that may cause the system to jam or otherwise deteriorate to the point of not performing its anti-drop function.

In another anti-drop system used in the industry, a rotating pawl placed within a housing is attached to the door's suspension cable. In this system, the rotatable pawl is held within the housing and attached to the cable by an eye that extends outside of the housing. A spring is interposed between the housing and the pawl such that when tension is on the cable, the spring is compressed. When tension is released from the cable, the spring drives the pawl downward where it engages an oblique face of a plunger corresponding to an oblique face of the pawl. This forces the pawl to rotate outward such that a portion of the pawl extends outside of the housing to engage a slot formed in a rail similar to that described with respect to the spring-loaded bar system. To effect the engagement between the pawl and plunger, the housing slides relative to the plunger. When tension is released form the cable, the housing moves downward such that a slot formed in the side of the housing is located at nearly the same height as the plunger. In this way, as the pawl is moved outwardly along the angle of the plunger, its tip can extend through the opening in the housing. The tip is provided with an oblique engagement portion that is turned outwardly to facilitate its extension through the slots in the rail. To permit the tip to rotate sufficiently to engage the slots, the housing must be spaced from the rail, and no provision is made to slow the door prior to impact.

While the use of the pawl reduces the distance that the stopping member must travel to prevent drop of the door and helps to reduce forces that might bend the pawl, this system is subject to the same corrosive elements as the spring-loaded bar system, and, due to its complexity, is even more susceptible to the effects of corrosion, which may cause the system to operate improperly or jam such that repair or replacement is necessary. Also, as in the case of the spring-loaded bar system, the reduction in tension on the cable as the door nears the open position could similarly result in unintended activation of the anti-drop mechanism.

DISCLOSURE OF THE INVENTION

It is therefore an object of the present invention to provide an upwardly-acting door system employing a simple anti-drop system to stop a falling door. Another object of the present invention is to provide an anti-drop system having a rotatable pawl assembly supported on the door, where the presence of a taut counterbalance cable between the pawl and the stop surface controls operation of the anti-drop system. Still another object of the present invention is to provide a cutout on the pawl to at least partially receive the counterbalance cable such that the cable is held within the recess as the pawl rotates toward its engaged position, helping to prevent the cable from interfering with proper engagement of the pawl.

Another object of the present invention is to provide an anti-drop system for an upwardly-acting door employing a rotatable pawl engaging a stop surface adjacent the door to stop the fall of the door, where the anti-drop system slows the downward movement of the door prior to engagement with the stop surface to reduce the shock of stopping the door. A further object of the present invention is to provide a pawl and/or stop surface with a greater frictional coefficient to slow the door prior to the pawl's contact with the stop surface.

Still another object of the present invention is to provide an anti-drop system that automatically resets upon application of tension to the door cable. A further object of the present invention is to provide a rotatable pawl that is held in a disengaged position by contact with a taut door cable, which, when the cable goes slack, allows the pawl to rotate to an engaged position to stop the door and, upon reapplication of tension to the cable, draws the pawl back into its disengaged position.

Yet another object of the present invention is to provide an upwardly-acting door having an anti-drop system that is less prone to the effects of corrosion or debris. A further object of the present invention is to provide an upwardly-acting door having an anti-drop system constructed of a polymeric material. Another object of the present invention is to provide an upwardly-acting door having an anti-drop system located away from the bottom edge of the door and placed in close relation to a stop surface preventing the entrance of debris or fluid that could corrode or otherwise interfere with the operation of the anti-drop system.

Still another object of the present invention is to provide a method of impeding the free-fall of an overhead door caused by loss of tension in a cable used in counterbalancing the door by interposing the cable between the safety stop assembly and a stop surface such that the cable, when taut, checks the biasing of the safety stop assembly and whereby a loss of tension within the cable releases the biasing force to urge the safety stop into engagement with the stop surface.

In light of at least one of the objects, the present invention contemplates a door system including a door movable between a closed vertical position and an open horizontal position, a cable interconnected to said door near the bottom thereof, the cable extending along a vertical line adjacent the door and being normally, substantially taut, and an anti-drop assembly having a pawl pivotally supported on the door, a stop surface formed adjacent the door and a spring operable to urge the pawl toward engagement with the stop surface, wherein the pawl is oriented such that it rotates in a plane passing through the cable and placed in contact therewith such that the taut cable opposes the biasing force of the spring, whereby upon the cable going slack, the spring biases the pawl into engagement with the stop surface to decelerate the door.

The invention further provides a method of impeding the free-fall of an overhead door caused by loss of tension in a cable used in counterbalancing the door comprising, providing a safety stop assembly adjacent the door adapted to selectively engage a stop surface to impede the free-fall of the door; biasing the safety stop assembly to rotate toward an engaged position with the stop surface; and interposing the cable between the safety stop assembly and the stop surface such that the cable when taut opposes the biasing of the safety stop assembly and whereby a loss of tension within the cable results in biasing of the safety stop assembly toward engagement with the stop surface.

PREFERRED EMBODIMENT FOR CARRYING OUT THE INVENTION

Figure 1:
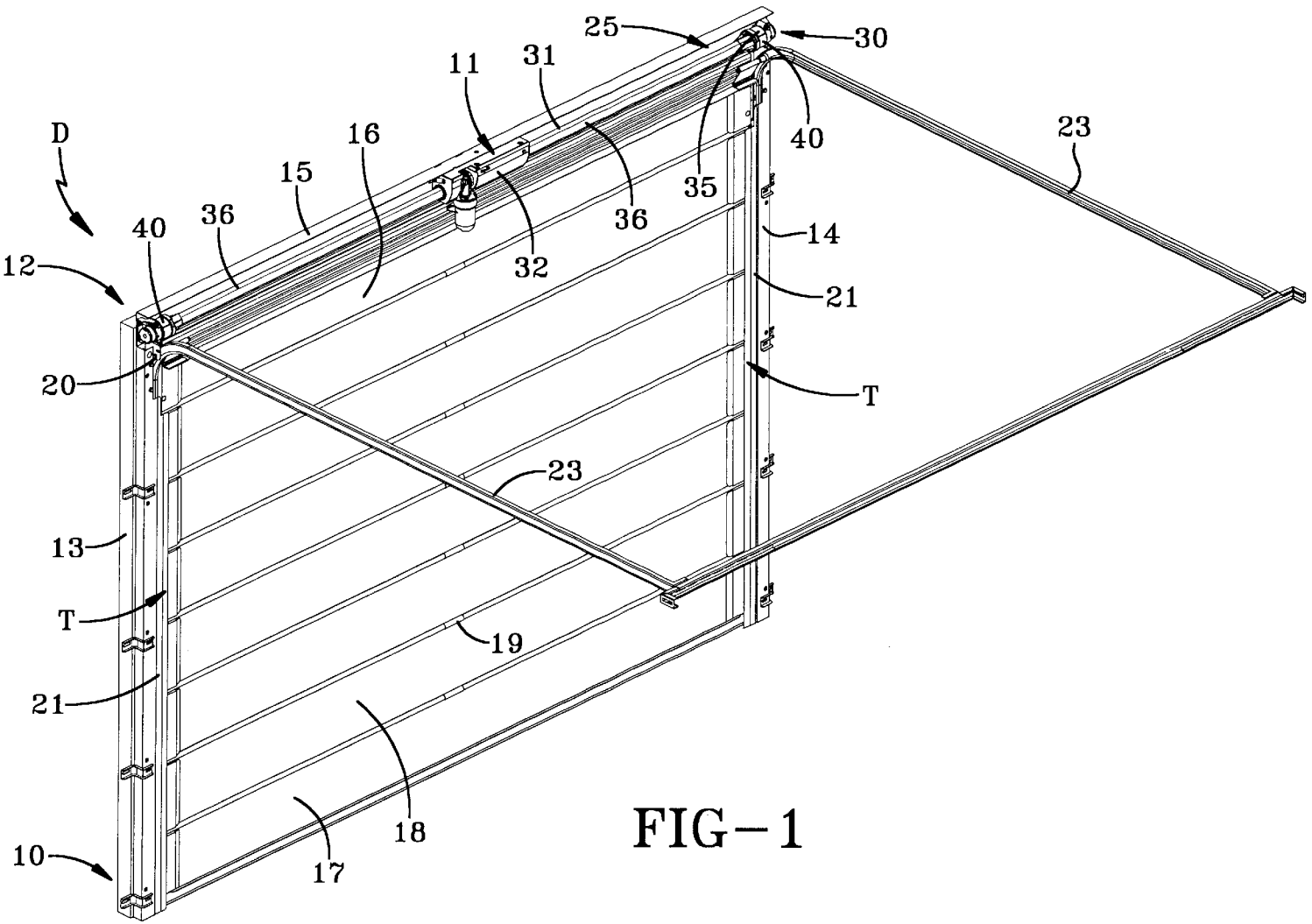
FIG. 1 is an interior perspective view of a sectional door with an anti-drop system according to the concepts of the present invention having a rotatable pawl operable with the door cable to control movement of the door upon a release of tension within the cable.

An anti-drop assembly according to the concepts of the present invention is generally indicated by the numeral 10 and is shown mounted in conjunction with a sectional door, generally indicated by the letter D, which may include an operator system, generally indicated by the numeral 11, which may be a type of jack shaft operator as employed particularly in garages for residential housing. The opening in which the door D is positioned for moving between a closed vertical position and an open horizontal position is defined by a frame, generally indicated by the numeral 12. The frame 12 consists of a pair of spaced jambs 13 and 14 that, as seen in FIG. 1, are generally parallel and extend vertically upwardly from the ground or a floor. The jambs 13, 14 are joined at their vertical upward extremity by a header 15 to thereby delineate a generally inverted U-shaped frame 12 around the opening for the door D. The frame 12 is normally constructed of wood, metal, or polymeric materials for purposes of reinforcement and facilitating the attachment of elements for supporting and controlling the door D, including the operator system 11. The door D has a top section 16, a bottom section 17, and one or more intermediate sections 18 which are interconnected by horizontally spaced hinges 19 in a manner well known to persons skilled in the art.

Affixed to the jambs 13, 14 proximate the upper extremities thereof and the lateral extremities of the header 15 to either side of the door D are flag angles, generally indicated by the numeral 20. The flag angles 20 generally consist of L-shaped vertical members having a first leg attached to an underlying jamb 13, 14 by lag bolts, or the like, and a projecting leg preferably disposed substantially perpendicular to the first leg and, therefore, perpendicular to the jambs 13, 14. A horizontal angle iron extends from the projecting leg and supports roller tracks T located to either side of door D. Tracks T provide a guide system for rollers R attached to either side of the door D, in a manner well known in the art, and generally have a vertical section 21 adjacent the door opening and a horizontal section 23 extending rearwardly of the opening. The horizontal angle irons normally extend substantially perpendicular to the jambs 13, 14 and may be attached to the transition portion of tracks T between the vertical section 21 and the horizontal section 23 thereof or at the beginning of the horizontal section of tracks T closest to the jambs 13, 14. The tracks T define the travel of the door D in moving between the closed vertical position and the open horizontal position.

The operator system 11 interrelates with the door D through counterbalance system, generally indicated by the numeral 25, which includes cable drum mechanisms, generally indicated by the numeral 30. As shown, the cable drum mechanisms 30 are positioned on a drive tube 31 which extends a substantial portion of the distance between the flag angles 20 to either side of the door D. If desired, the drive tube 31 could be constructed of two or more telescoping members to facilitate packaging, assembly, and/or adjustment. As shown, the cable drum mechanisms 30 are positioned on the drive tube 31 at the ends thereof and are in all instances nonrotatably affixed to the drive tube 31. As seen in FIG. 1, the operator system 11 may have an operator housing 32 which encloses a length of drive tube 31 that interacts with the operator drive elements (not shown) in a manner known to persons skilled in the art to selectively effect rotational drive of the drive tube 31 in both rotational directions to supply the power required for moving the door D between the closed vertical position and the open horizontal position. While drive tube 31 may be a hollow tubular member that is noncircular in cross-section, it is to be appreciated that circular drive tubes, solid shafts and other types of driving elements capable of rotating the cable drum mechanisms 30 may be employed and are encompassed within this terminology in the context of this specification.

The cable drum mechanisms 30 each include a generally cylindrical cable drum 35 which is provided, at its inboard end, with an axially projecting drum sleeve 36 which receives drive tube 31 and may be provided with a plurality of circumferentially spaced reinforcing ribs. The drum sleeve 36 is attached to the drive tube 31, as by bolts, a key, or the like such that cable drums 35 rotate with the drive tube 31. The cable drums 35 have a substantially cylindrical surface 40 provided with continuous helical grooves that receive a counterbalance cable 45 in a coiled fashion.

The counterbalance cable 45 may be of a construction commonly employed in the industry and has one extremity secured to the bottom section 17 of door D. The other end of the cable 45 is fastened to the cable drum 35, where it is looped or reeved one full turn around the cable drum 35 and through an additional, approximately ninety degree, interval before the cable 45 departs tangentially downwardly to where it is anchored to the edge cap 46 of bottom section 17 with the door D in the closed position seen in the drawings.

Under ordinary operating conditions, to raise the door D, the operator system 11 causes rotation of the drive tube 31 and accordingly cable drums 35 to wind the cable 45 about the cable drums 35. During this operation, the cable 45 is taut between the cable drum 35 and the point at which it attaches to bottom panel 17. If the cable 45 goes slack or is broken, the weight of the door D is no longer balanced by the counter balance system 25 and the door D may drop. As a result, persons or objects within the opening of door D may be struck by the falling door D resulting in serious damage or injury. To help avoid such a circumstance, the anti-drop assembly 10 acts as a stop, when tension is released from the cable 45, as now will be described.

Anti-drop assembly 10 includes a stop assembly, generally indicated by the numeral 50, that, upon release of tension within cable 45, interacts with a stop surface, generally indicated by the numeral 47, which maybe made integral with the jamb 13 or the track T, to provide a stopping force against the free fall of door D. To provide a positive stop, as opposed to relying on frictional forces generated between the stop assembly 50 and stop surface 47, the stop surface 47 may include a surface 48 normal to the direction of the falling door. This surface 48 may extend outward in the form of a projection or be an edge of a notch 49 formed in stop surface 47 as shown.

Figure 2:
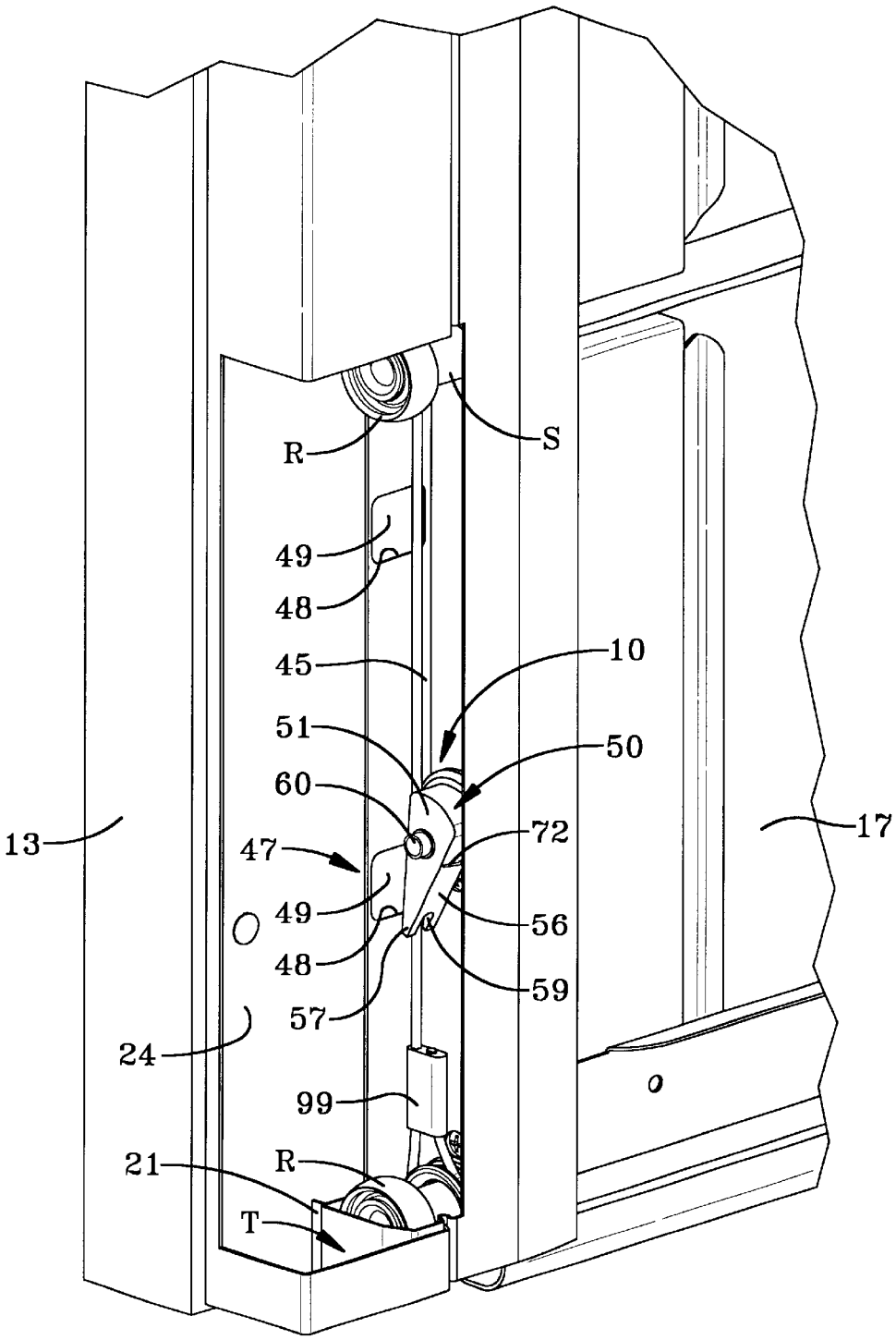
FIG. 2 is an enlarged fragmentary perspective view of a portion of FIG. 1, depicting the anti-drop system on the left side of a door as seen in FIG. 1 showing details of the interrelation of the cable and pawl in the anti-drop system.

Stop assembly 50 also includes a pawl 51 which, as will hereinafter be described, is rotatable to engage one or more notches 49. Pawl 51 may generally be of any shape capable of engaging the stop surface 47 including the wedge shape shown. In the embodiment shown, the pawl 51 has opposed planar faces 56 converging at a flattened tip 57. The tip 57 provides a stopping surface oriented to engage the internal edge 48 of notch 49. The tip 57 of pawl 51 may be provided with a cutout or notch 59 for receipt of cable 45 therethrough. As a result, stop assembly 50 is located proximate to cable 45 such that the tensioned cable 45 holds the pawl 51 in its unlocked position (FIG. 2).

The pawl 51 may be supported on door D by a generally planar mounting bracket, generally indicated by the numeral 61. To avoid interference with the operation of door D, mounting bracket 61 may be profiled to fit within the boundaries of the end cap 46 of bottom panel 17. Mounting bracket 61 maybe attached to the bottom panel 17 directly or to end cap 46, as by cap screws 53, 54. Cap screws 53, 54 may be driven into countersunk receivers 63 formed in the face 58 of bracket 61, which maybe aligned with openings 62 in end cap 46.

A pivot member, generally indicated by the numeral 60, extends axially outward from mounting bracket 61 to receive pawl 51. Pawl 51 is provided with a bore 64 to receive pivot member 60, such that pawl 51 may rotate about pivot member 60. Pivot member 60 may include a concentrically recessed tip 65 that extends axially toward track T beyond the pawl 51, when the pawl 51 is installed. Further, the base 66 of pivot member 60 maybe provided with an annular gusset 67 to reinforce pivot member 52 and space pawl 51 from face 58 to avoid binding therebetween.

Figure 3:
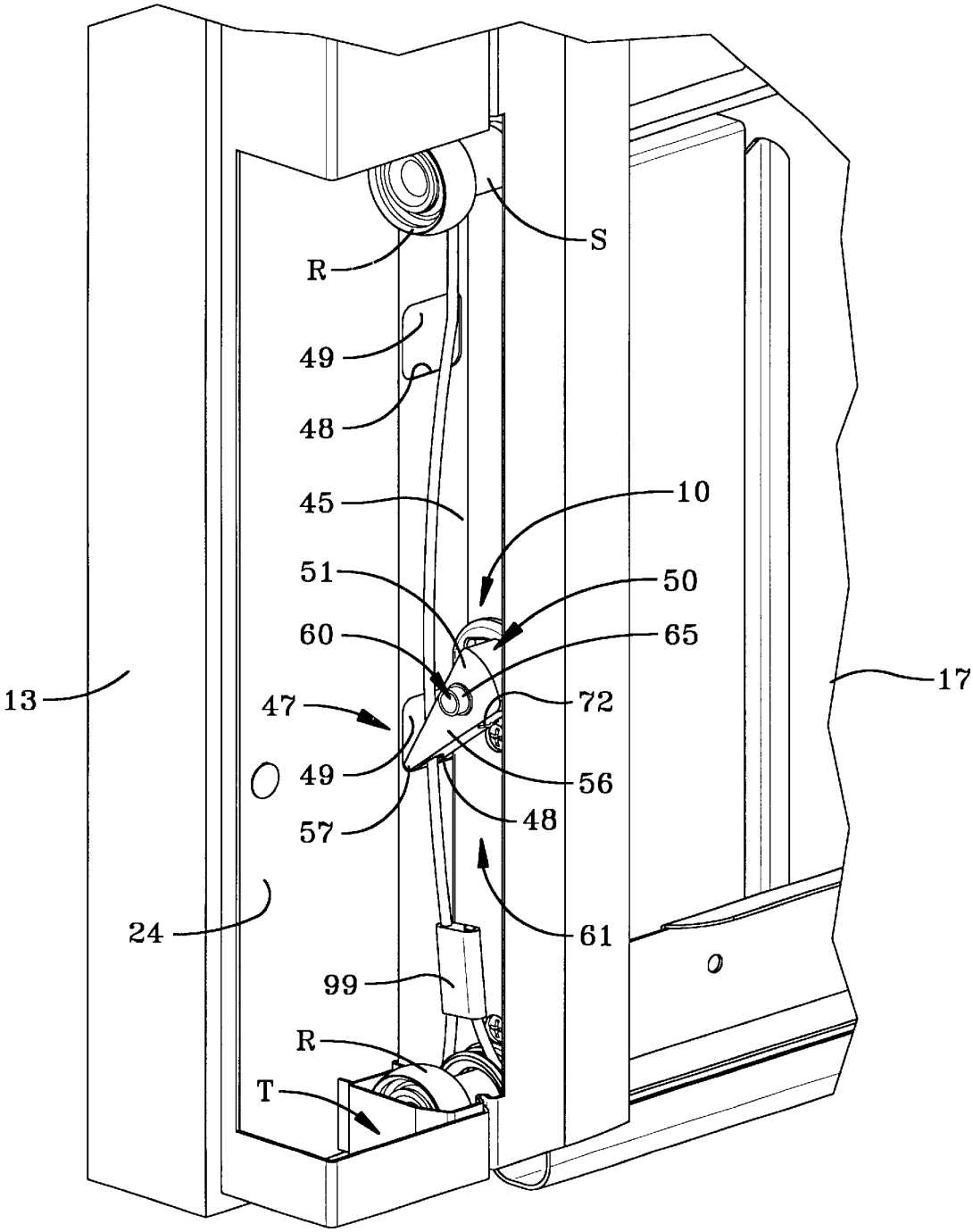
FIG. 3 is an enlarged fragmentary perspective view depicting the anti-drop system in an engaged position showing a slack cable that no longer resists the biasing force applied to the pawl allowing the pawl to rotate into engagement with a stop surface aligned perpendicular to the cable.
Figure 5:
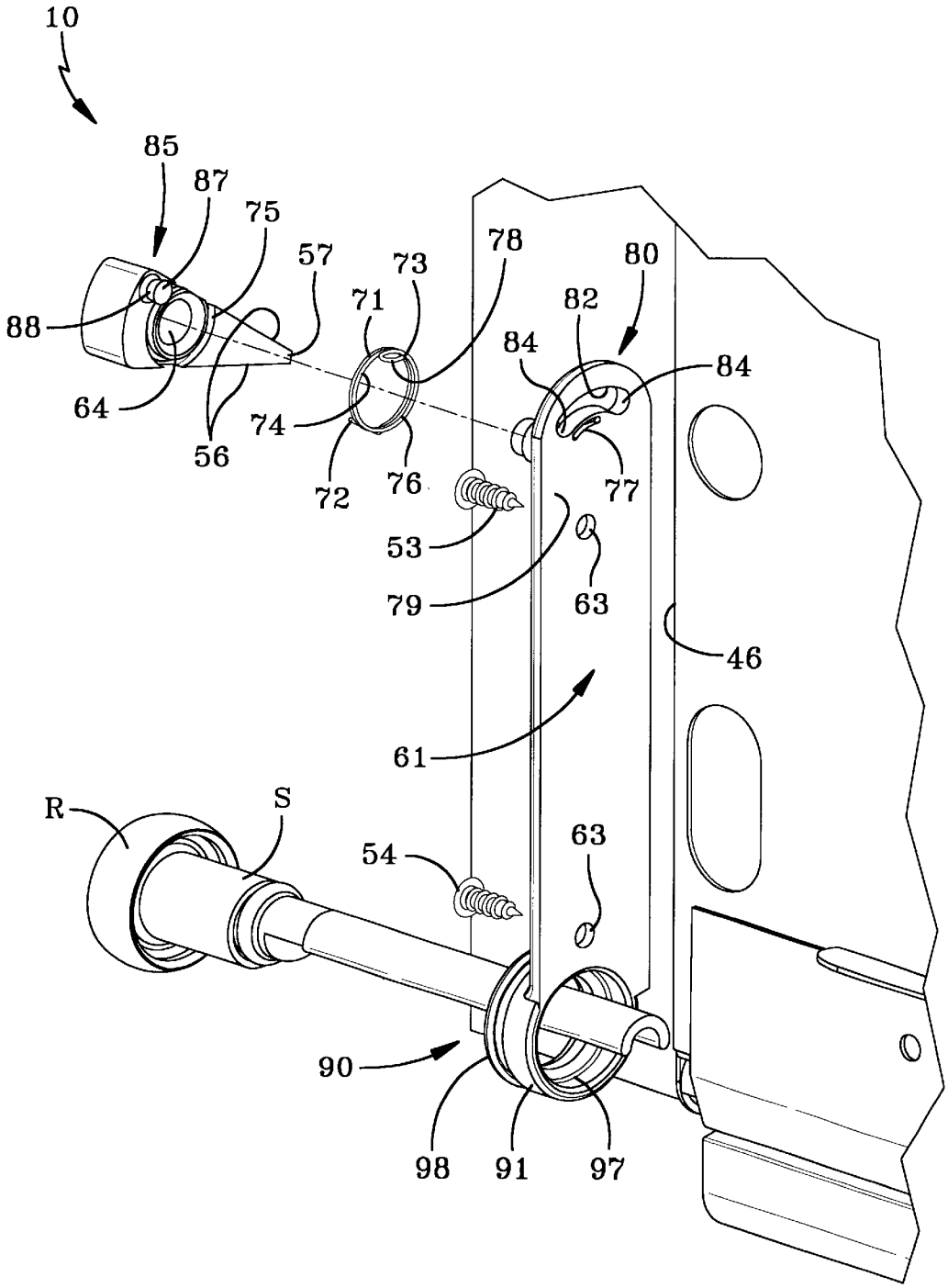
FIG. 5 is an enlarged fragmentary exploded view similar to FIG. 4 but rotated 180° to show additional details of the anti-drop system.

A biasing assembly, generally indicated by the numeral 70, may be operatively interconnected with the pawl 51 and mounting bracket 61 to bias pawl 51 toward an engaged position (FIG. 3). The biasing assembly 70 may include a coil spring 71 having a first end 72 and a second end 73, where coil spring 71 defines an opening 74 sized to fit over pivot member 60. First end 72 extends in the axial direction generally perpendicular to the coils 76 of spring 71 to engage pawl 51. As best shown in FIG. 5, pawl 51 is provided with an annular recess 75 to receive the coils 76 of spring 71 with the first end 72 being subjacent to the pawl 51. The second end 73 of spring 71 extends in the axial direction toward mounting bracket 61 and is received within a slot 77 formed with the mounting bracket 61. Second end 73 may be provided with a catch 78, as by bending it to form a hook-like end on second end 73, to engage the rear surface 79 of mounting bracket 61. To install spring 71, the catch 78 is inserted axially through the appropriately sized slot 77, and then rotated until the catch 78 lies adjacent to the rear surface 79 of mounting bracket 61. In this way, catch 78 would help resist axial movement of the spring 71 that might cause it to come free of the mounting bracket 61. In a manner known to those skilled in the art, relative displacement of the first and second ends 72, 73 causes the spring 71 to exert a biasing force that urges the pawl 51 toward the locked position (FIG. 3).

Figure 4:
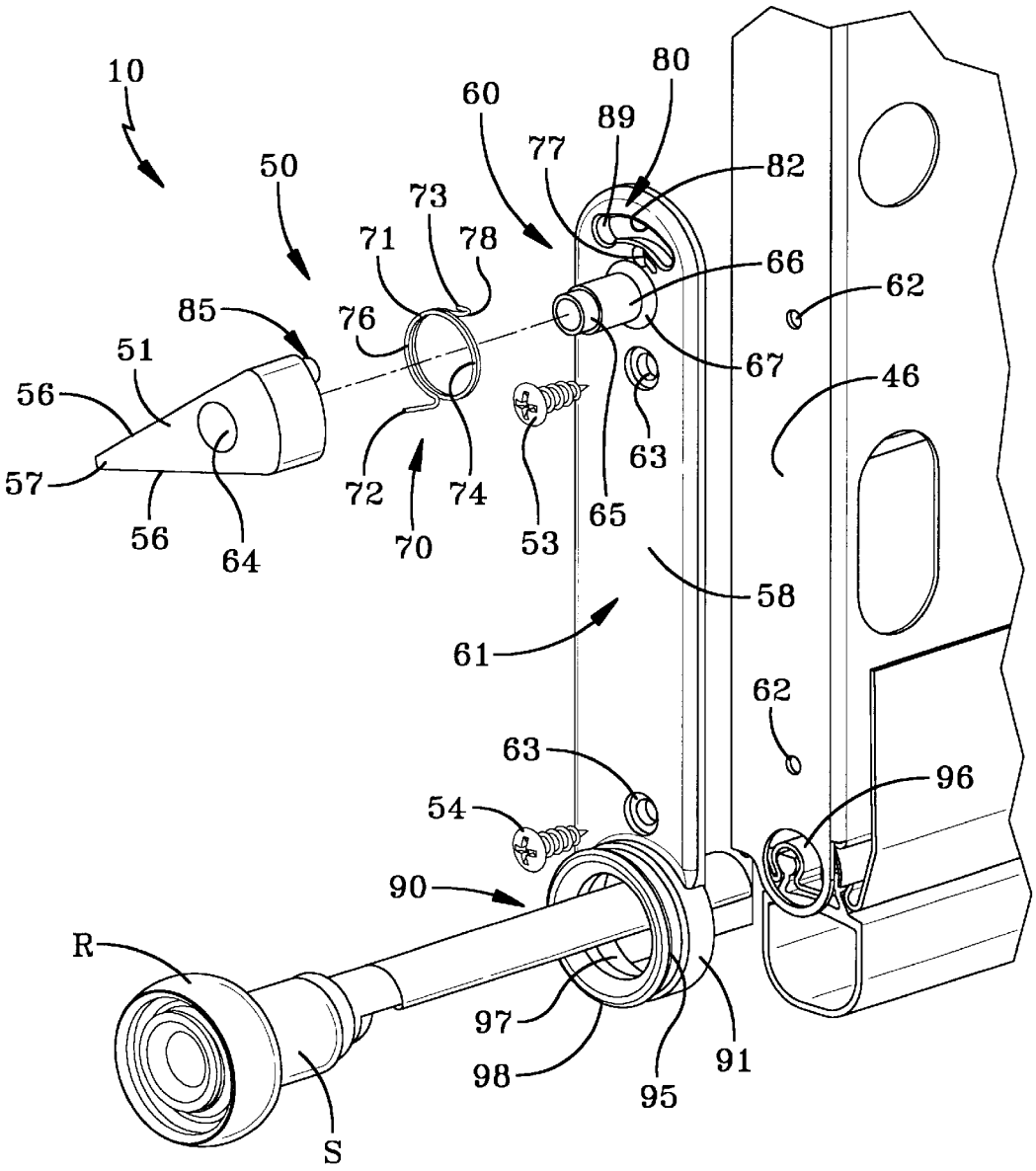
FIG. 4 is an enlarged exploded view of the anti-drop assembly and bottom section of a door as seen in FIG. 1 depicting assembly of the anti-drop system.

When installed, spring 71 is pre-tensioned by rotating pawl 51 away from the engaged position. Cable 45 is interposed between the pawl 51 and the track T and secured to the bottom panel 17 of the door D. With the cable 45 taut (FIG. 2), the force of spring 71 is checked by the cable 45. If tension is released from the cable 45 causing it to go slack (FIG. 3), the spring 71, unchecked, urges the pawl 51 toward the locked position (FIG. 3). To limit the range of motion of pawl 51, a guide assembly, generally indicated by the numeral 80, may be provided. Guide assembly 80 generally includes a guide surface that interacts with at least a portion of pawl 51 to restrict its movement. As best shown in FIG. 4, the guide surface may be made part of a slot 82 formed within the mounting bracket 61. The ends 84 of slot 82 act as stops to the rotation of pawl 51. To interact in this fashion with slot 82, a projection, generally indicated by the numeral 85, extends from pawl 51 toward slot 82. When the pawl 51 is installed on pivot member 60, at least a portion of projection 85 rests within the confines of slot 82 such that contact between the ends 84 and projection 85 act to limit the motion of pawl 51. To allow for the curvilinear motion of the projection 85, slot 82 is made arcuate and tracks an arc length corresponding to the desired degree of rotation for pawl 51.

The base 87 of projection 85 is made larger than the body 88 of projection 85 such that the base may be snap-fit to the mounting bracket 61 at a selected point within slot 82 such as an entry portion 89 (FIG. 4) of slot 82 sized to receive base 87. Entry portion 89 is located at the end 84 closest to the forward edge of track T. The remaining portion of slot 82 is sized to conform to the dimensions of body 88 such that, while within this portion, the base 87 may not move axially outward toward pawl 51 resulting in inadvertent axial release of the pawl 51.

Figure 2A:
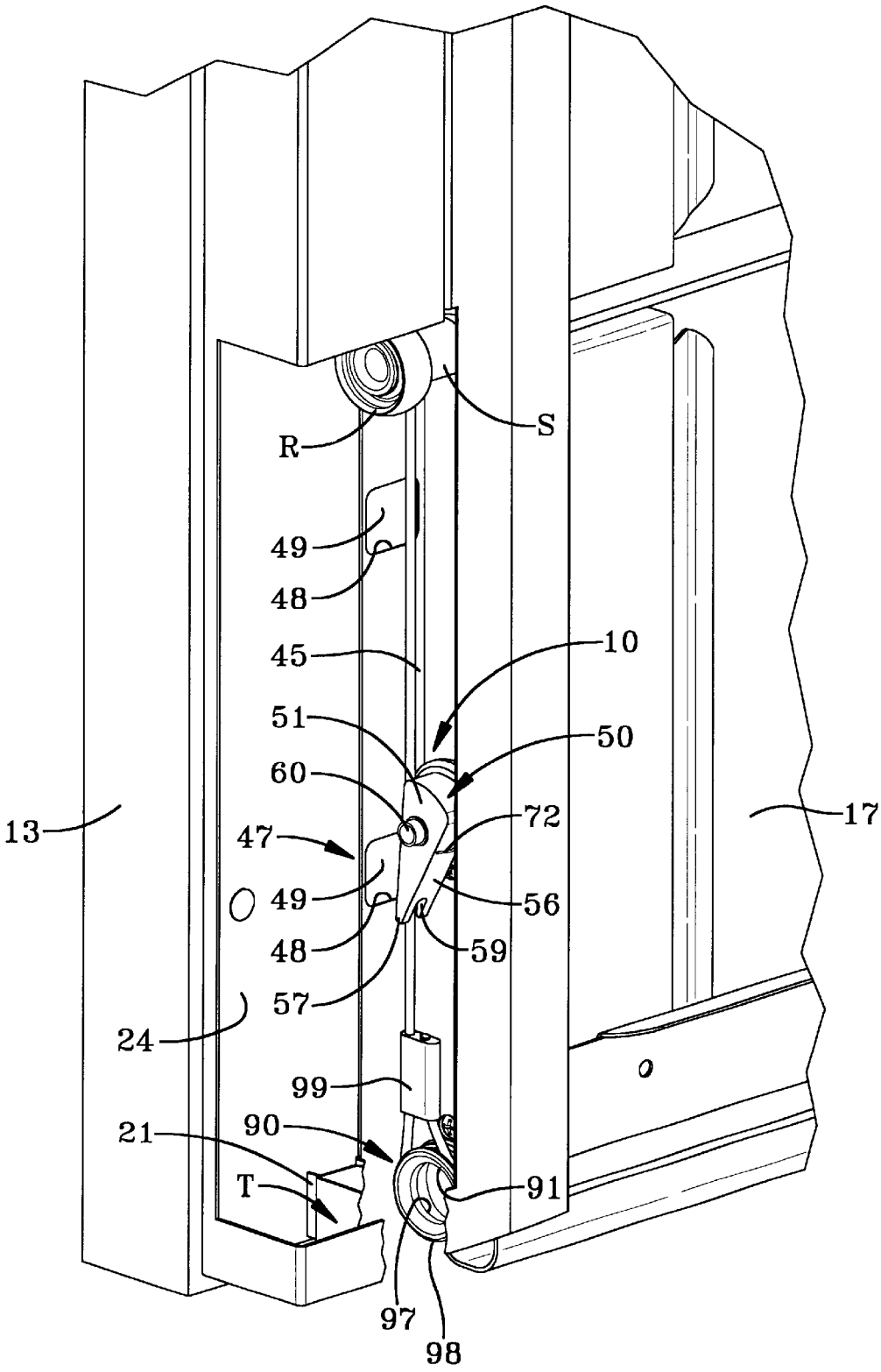
FIG. 2A is an enlarged fragmentary perspective view similar to FIG. 2 with a portion of the jamb cut away and the roller removed to show details of the attachment of the cable to the lower part of the door.

Thus, to assemble pawl assembly 50, as shown in FIGS. 4 and 5, spring 71 is located within recess 75 with the first end 72 of spring 71 lying beneath pawl 51. The pawl 51 is slipped over pivot member 60 and aligned such that the second end 73 of spring 71 may be inserted within slot 78. Then, pawl 51 may be rotated counter-clockwise tensioning the spring 71 and locating projection 85 to be inserted through entry portion 89. So located, projection 85 may be snapped into place. With the pawl 51 attached, cable 45 is interposed, as described, to hold the pawl 51 in an unlocked position (FIG. 2). As shown in the drawings, as an alternative to a conventional attachment of the cable 45 to door D, mounting bracket 61 may be provided with a cable attachment assembly, generally indicated by the numeral 90. Cable attachment assembly 90 includes an attachment member 91 that preferably aligns the cable 45 with the pawl 51 to ensure that the cable 45, when taut, checks the pawl 51 preventing it from attaining the locked position. Cable receiving notch 59 at the tip 57 of the pawl 51 helps maintain this alignment. In the embodiment shown, attachment member 90 is provided with a recess 95 aligned with notch 59 such that the cable 45 extends in a straight line from notch 59 to recess 95. Attachment member 91 is located coaxially with an opening 96 in bracket 46 where roller R attaches to the bottom panel 17. To apply force generated by the operator 11 below roller R, attachment member 91 is made annular providing an aperture 97 through which the shaft S of roller R may be inserted. As best shown in FIG. 2A, cable 45 is extended around the lower portion 98 of attachment member 91 within recess 95 and then tied off, as by a clasp 99. Thus, when the operator 11 is activated to raise the door D, tension on cable 45 is applied to the attachment member 91 and communicated to the bottom panel 17 of door D via screws 53, 54 or shaft S.

It will be appreciated that when the door D is in the closed position, the cable 45 may be slack allowing the pawl 51 to rotate to the locked position. As tension is reapplied to the cable 45, the pawl 51 is urged toward the disengaged position, by cable 45, automatically resetting pawl 51 for uninhibited operation of the door D. Consequently, as the door D is opened and closed, the pawl 51 and its related components are cycled between the locked and unlocked positions helping to reduce the amount of corrosion, dust, or debris that would ordinarily build up on these members when left stationary. To stop the door D from unintended free-fall, pawl 51 interacts with stop surface 47 which, upon contact with pawl 51, applies a force opposite to the direction of the door's travel. The stop surface 47 is generally located proximate to stop assembly 50 to allow interaction therebetween and runs parallel to the track T. Stop surface 47 maybe provided on jambs 13 or 14 having notches 49. The notches 49 may have rectangular openings in which the pawl 51 may enter. The lower surfaces 48 of the notches 49 are preferably generally perpendicular to the direction of travel of the door D and the tip 57 of pawl 51. As shown in the figures, the notches 49 may be periodically spaced along the jambs 13, 14 to provide a number of stop points thereon. While the stop surface 47 may conventionally be constructed of wood or metal, polymeric materials may alternatively be used to provide a somewhat forgiving surface that would cushion contact between the pawl 51 and stop surface 47. Likewise, the pawl 51 may be partially or entirely constructed of similar polymeric material. In addition to being more resistant to corrosion, the frictional characteristics of these materials may help slow the descent of the door D when the pawl 51 is contacting the jambs 13, 14 or stop surface 47 between inset portions 49.

Thus, it should be evident that the counterbalance system disclosed herein carries out one or more of the objects of the present invention set forth above and otherwise constitutes an advantageous contribution to the art. As will be apparent to persons skilled in the art, modifications can be made to the preferred embodiment disclosed herein without departing from the spirit of the invention, the scope of the invention herein being limited solely by the scope of the attached claims.

What is claimed is:

1. A door system comprising, a door movable between a closed vertical position and an open horizontal position, a cable interconnected to said door near the bottom thereof, said cable extending along a vertical line adjacent said door and being normally substantially taut, and an anti-drop assembly having a pawl pivotally supported on said door, a stop surface formed adjacent to said door, and a spring operable to urge said pawl toward engagement with said stop surface, wherein said pawl is oriented such that it rotates in a plane passing through said cable and is maintained in contact therewith such that said taut cable opposes the biasing force of said spring, whereby upon the cable going slack, said spring biases said pawl into engagement with said stop surface to decelerate said door, said stop surface having a plurality of spaced shallow notches for engagement by said pawl.

2. The door system of claim 1 further comprising, an anti-drop assembly bracket attached to an edge of the door, a pivot member supported on said bracket extending axially outward from said door and adapted to receive said pawl.

3. The door system of claim 2, wherein said spring has a first and a second end, said first end engaging said pawl and said second end engaging said anti-drop assembly bracket.

4. The door system of claim 3, wherein said anti-drop assembly bracket includes a receiver, wherein said second end of said spring engages said receiver.

5. The door system of claim 4, wherein said receiver is a slot formed within said bracket, said first end of said spring extending into said slot.

6. The door system of claim 5, wherein said second end of said spring carries a catch operable with said receiver to axially restrict said spring.

7. A door system comprising, a door movable between a closed vertical position and an open horizontal position, a cable interconnected to said door near the bottom thereof said cable extending along a vertical line adjacent said door and being normally substantially taut, and an anti-drop assembly having a pawl pivotally supported on said door, a stop surface formed adjacent to said door, a spring operable to urge said pawl toward engagement with said stop surface, wherein said pawl is oriented such that it rotates in a plane passing through said cable and is maintained in contact therewith such that said taut cable opposes the biasing force of said spring, whereby upon the cable going slack, said spring biases said pawl into engagement with said stop surface to decelerate said door, an anti-drop assembly bracket attached to an edge of the door, and a pivot member supported on said bracket extending axially outward from said door and adapted to receive said pawl, said spring having a first and a second end, said first end engaging said pawl and said second end engaging said anti-drop assembly bracket, said anti-drop assembly bracket including a receiver, wherein said second end of said spring engages said receiver, said receiver being a slot formed within said bracket, said first end of said spring extending into said slot, said second end of said spring carrying a catch operable with said receiver to axially restrict said spring, said catch being formed as a bent end of said second end, said bent end extending through said slot and engaging a rear surface of said bracket.

8. The door system of claim 7, wherein said pawl defines a recess for receiving said spring, whereby said pawl is mounted substantially flush with said bracket.

9. The door system of claim 8, wherein said first end of said spring extends from said recess and engages a surface of said pawl away from said cable.

10. A door system comprising, a door movable between a closed vertical position and an open horizontal position, a cable interconnected to said door near the bottom thereof, said cable extending along a vertical line adjacent said door and being normally substantially taut, and an anti-drop assembly having a pawl pivotally supported on said door, a stop surface formed adjacent to said door, and a spring operable to urge said pawl toward engagement with said stop surface, wherein said pawl is oriented such that it rotates in a plane passing through said cable and is maintained in contact therewith such that said taut cable opposes the biasing force of said spring, whereby upon the cable going slack, said spring biases said pawl into engagement with said stop surface to decelerate said door, wherein said pawl is wedge-shaped having a first side and a second side tapering to a tip, wherein said tip contacts said cable and engages said stop surface.

11. The door system of claim 10 further comprising a cutout formed in said tip to receive at least a portion of said cable.

12. The door system of claim 11, wherein said cutout is centered within said tip such that at least a portion of said cable is laterally restrained within said cutout.

13. In a door system having, a door movable between a closed vertical position and an open horizontal position and having a cable interconnected to said door near the bottom thereof, and extending along a vertical line adjacent said door and being normally substantially taut, an anti-drop assembly comprising, a pawl adapted to be pivotally supported on the door, a stop surface mounted adjacent to the door, and means for urging said pawl toward engagement with said stop surface, wherein said pawl is oriented to rotate in a plane passing through the cable and is maintained in contact therewith, such that the cable, when slack, permits said pawl to engage said stop surface to decelerate the door, said stop surface having a plurality of spaced shallow notches for engagement by said pawl.

14. A door system comprising, a door movable between a closed vertical position and an open horizontal position, a cable interconnected to said door, said cable extending along a vertical line adjacent said door and being normally substantially taut, and an anti-drop assembly having a pawl pivotally mounted on said door, a stop surface mounted adjacent to said door, a spring operable to urge said pawl toward engagement with said stop surface, a tip of said pawl receiving said cable and maintaining said cable in contact therewith such that said taut cable opposes the biasing force of said spring, whereby upon the cable going slack, said spring biases said tip of said pawl into engagement with said stop surface to decelerate said door, and a guide assembly limiting the pivotal movement of said pawl having a mounting bracket attached to said door having a slot therein and a projection on said pawl engaging said slot.

15. The door system according to claim 14, wherein said projection has a body portion and a base portion at the extremity of and larger than said body portion and said slot has an enlarged entry portion for receiving said base portion, whereby said base portion retains said pawl pivotally attached to said mounting bracket except at said entry portion.

16. A door system comprising, a door movable between a closed vertical position and an open horizontal position, a cable interconnected to said door, said cable extending along a vertical line adjacent said door and being normally substantially taut, and an anti-drop assembly having a pawl pivotally mounted on said door, a stop surface mounted adjacent to said door, a spring operable to urge said pawl toward engagement with said stop surface, a tip of said pawl receiving said cable and maintaining said cable in contact therewith such that said taut cable opposes the biasing force of said spring, whereby upon the cable going slack, said spring biases said tip of said pawl into engagement with said stop surface to decelerate said door and said stop surface has a plurality of spaced shallow notches for engagement by said tip of said pawl.

17. The door system according to claim 16, wherein said tip of said pawl has a notch for receiving said cable.

18. The door system according to claim 16, further comprising, an attachment assembly interconnecting said cable to said door.

19. The door system according to claim 18, wherein said attachment assembly includes an annular member having a recess for receiving said cable which with said pawl maintains said cable in said vertical line adjacent said door when taut.

20. The door system according to claim 16, wherein said notches have a lower surface that is substantially perpendicular to the direction of travel of said door and the length of said pawl when in engagement with said lower surface to stop downward travel of said door.

21. The door system according to claim 20, wherein either of said pawl and said stop surface are constructed of a polymeric material.

22. The door system according to claim 20, wherein both said pawl and said stop surface are constructed of a polymeric material.

* * * * *